US010487460B2

(12) United States Patent
Lee

(10) Patent No.: US 10,487,460 B2
(45) Date of Patent: Nov. 26, 2019

(54) DECK MODULE INCLUDING QUICK CLIP MODULE

(71) Applicant: Kyeong Jun Lee, Incheon (KR)

(72) Inventor: Kyeong Jun Lee, Incheon (KR)

( * ) Notice: Subject to any disclaimer, the term of this patent is extended or adjusted under 35 U.S.C. 154(b) by 0 days.

(21) Appl. No.: 16/244,074

(22) Filed: Jan. 9, 2019

(65) Prior Publication Data

US 2019/0249376 A1 Aug. 15, 2019

(30) Foreign Application Priority Data

Feb. 14, 2018 (KR) ..... 10-2018-0018733

(51) Int. Cl.

| | |
|---|---|
| ***E04F 15/02*** | (2006.01) |
| ***E01C 15/00*** | (2006.01) |
| ***E04B 1/00*** | (2006.01) |
| ***E04B 5/12*** | (2006.01) |
| ***E04F 15/22*** | (2006.01) |
| *E01C 11/24* | (2006.01) |

(52) U.S. Cl.

CPC ..... *E01C 15/00* (2013.01); *E04B 1/003* (2013.01); *E04B 5/12* (2013.01); *E04F 15/02011* (2013.01); *E04F 15/02038* (2013.01); *E04F 15/02044* (2013.01); *E04F 15/225* (2013.01); *E01C 11/24* (2013.01)

(58) Field of Classification Search

CPC ..... E04B 1/003; E04F 15/02005; E04F 15/02022; E04F 15/02038; E04F 15/02044; E04F 15/02494; E04F 2201/0511; E04F 2201/0523

USPC ..... 14/73, 73.1; 404/18, 33, 38, 40, 41, 43

See application file for complete search history.

(56) References Cited

U.S. PATENT DOCUMENTS

| | | | | |
|---|---|---|---|---|
| 6,766,749 | B2 * | 7/2004 | Lacabanne ..... | B65D 19/0085 108/56.3 |
| 9,297,397 | B2 * | 3/2016 | Peck ..... | F16B 5/0685 |
| 9,458,635 | B1 * | 10/2016 | Anic ..... | E04F 15/02183 |
| 2013/0025230 | A1 * | 1/2013 | Turner ..... | E04F 15/02044 52/586.1 |
| 2016/0208487 | A1 * | 7/2016 | Peck ..... | F16B 5/0685 |

FOREIGN PATENT DOCUMENTS

| | | |
|---|---|---|
| KR | 10-1754110 B1 | 7/2017 |
| KR | 10-1754112 B1 | 7/2017 |

* cited by examiner

*Primary Examiner* — Gary S Hartmann
(74) *Attorney, Agent, or Firm* — Revolution IP, PLLC

(57) ABSTRACT

A deck module includes deck panels having a plate shape extending in a first direction and having deck grooves formed in both side surfaces thereof in the first direction, a bottom structure disposed on lower portions of the deck panels in a second direction crossing the first direction, and quick clip modules connected to a side surface of the bottom structure, wherein the quick clip modules comprise quick clip bases extending in the second direction, quick clip protrusions protruding from the quick clip bases in a third direction orthogonal to the first direction and the second direction and having protrusion portions formed at ends of the quick clip protrusions to protrude in the second direction and correspond to the deck grooves, and quick clip supports protruding from the quick clip protrusions in the first direction.

3 Claims, 15 Drawing Sheets

[Figure.2]
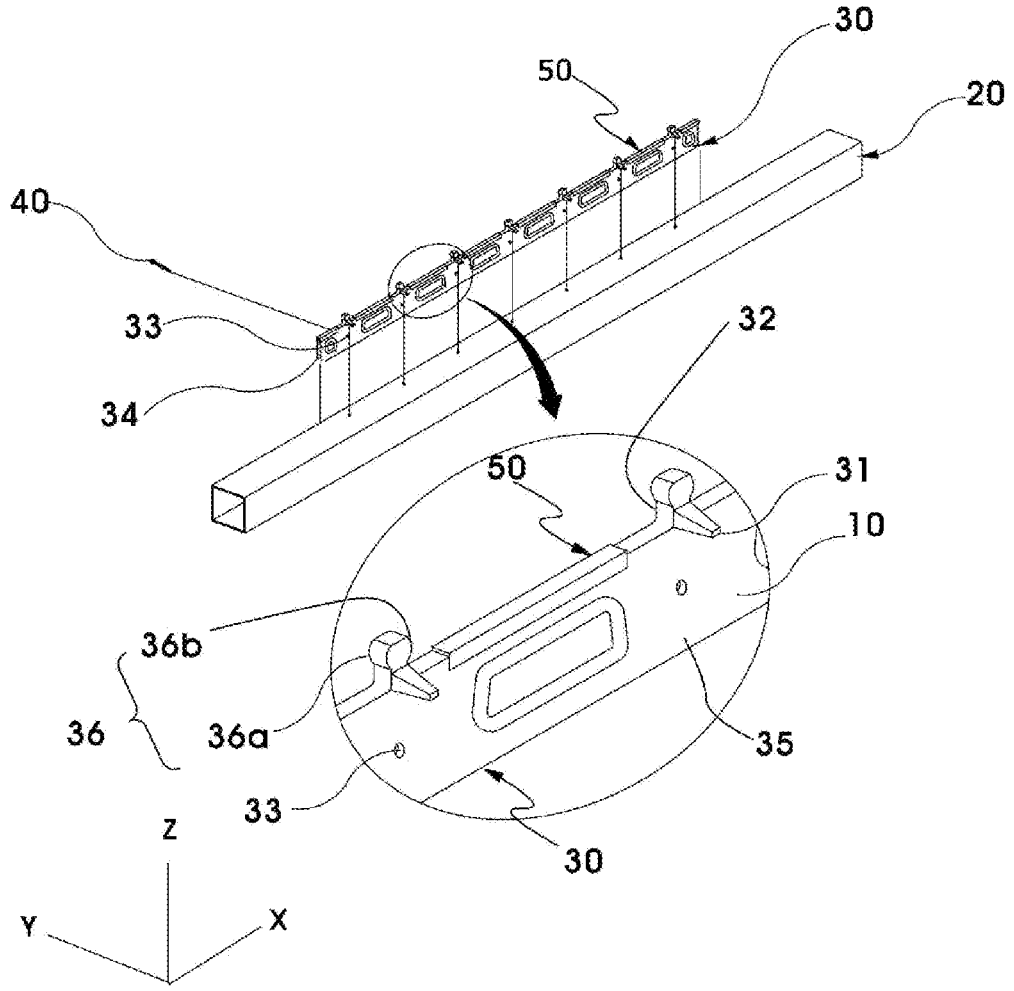

[Figure.3]
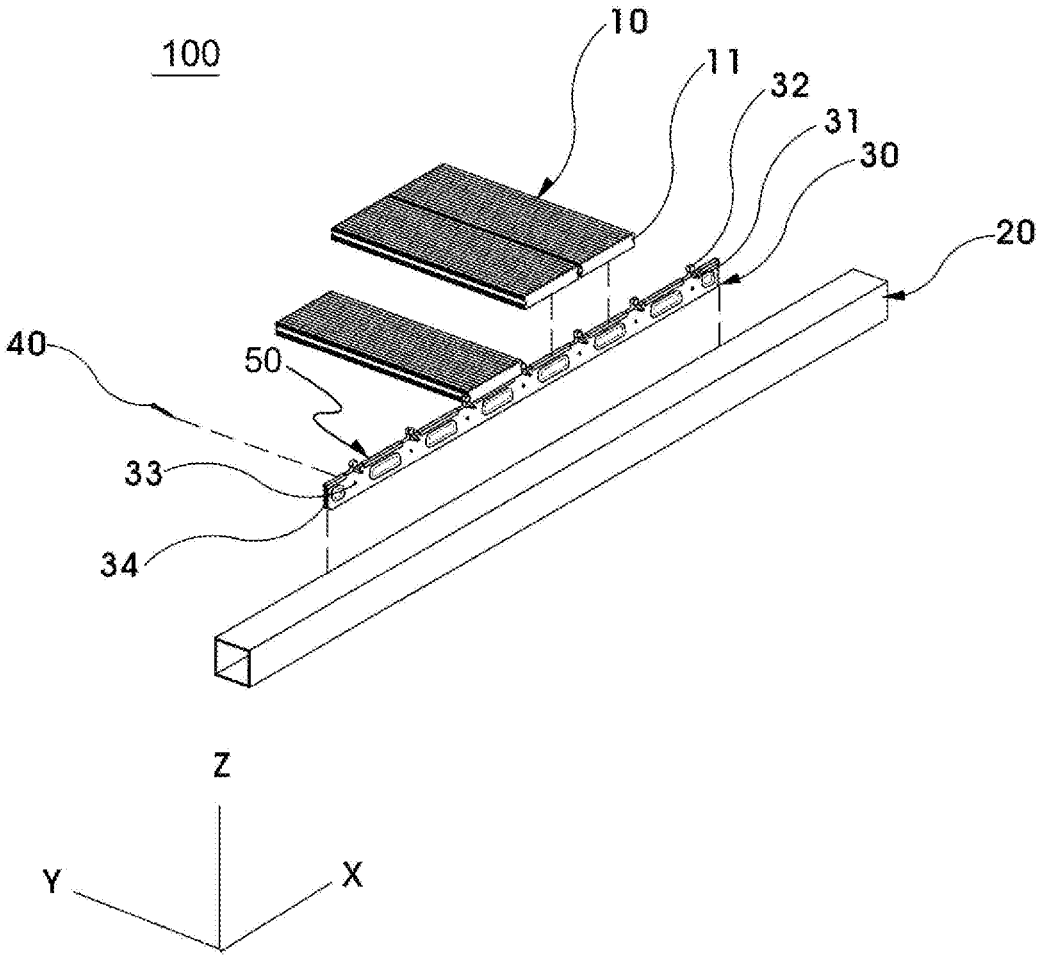

[Figure.5]
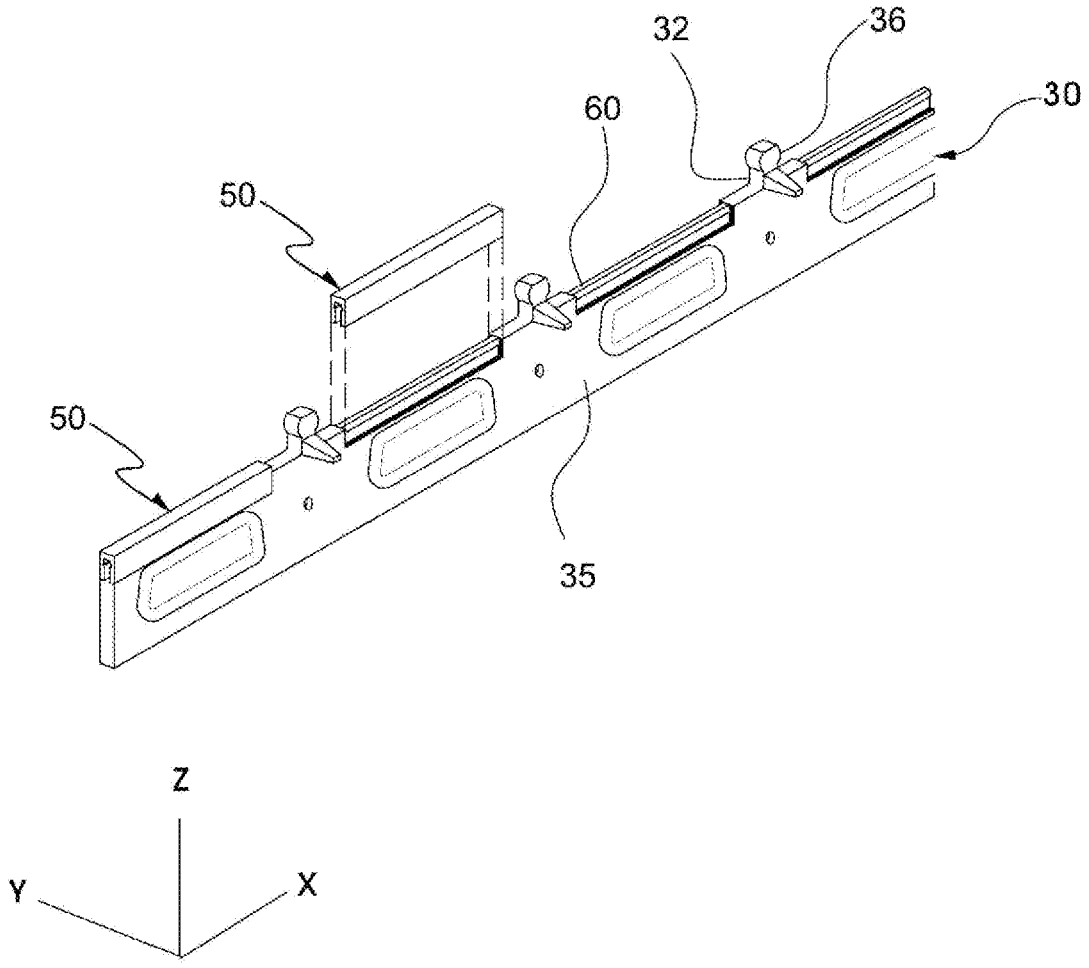

[Figure.6]
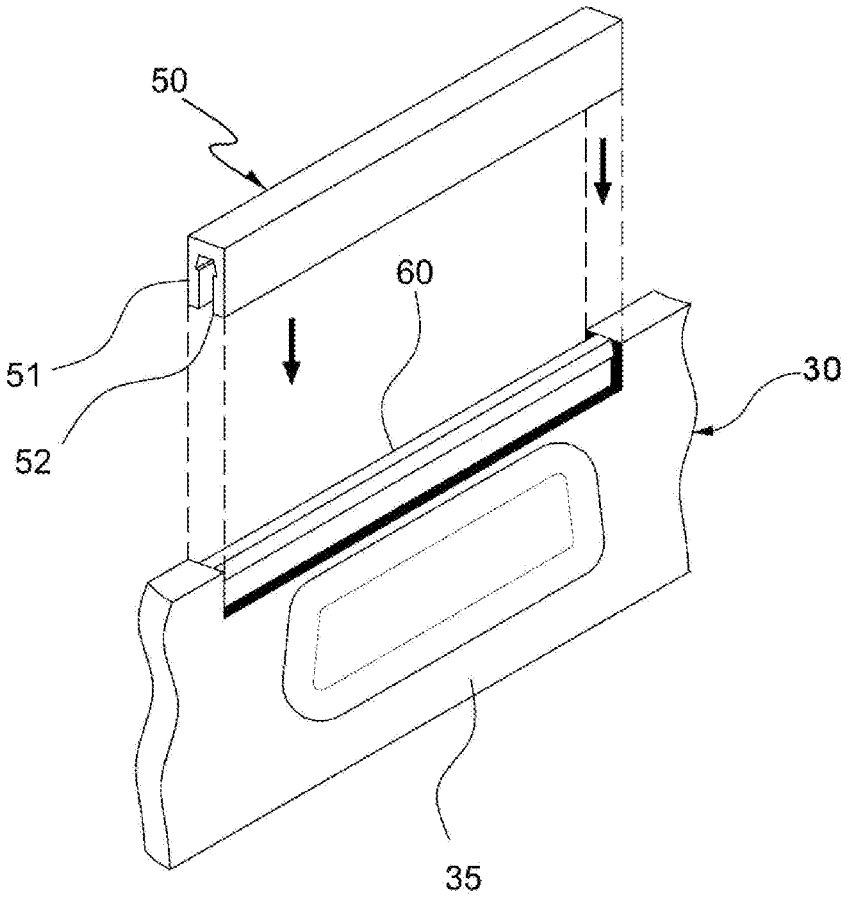

[Figure.8]
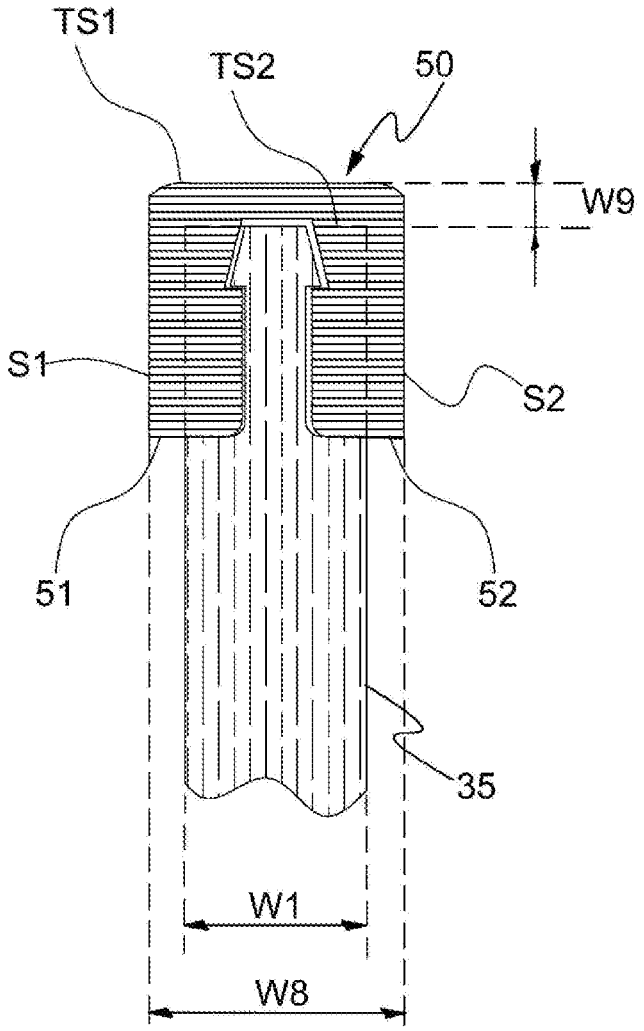

[Figure.9]
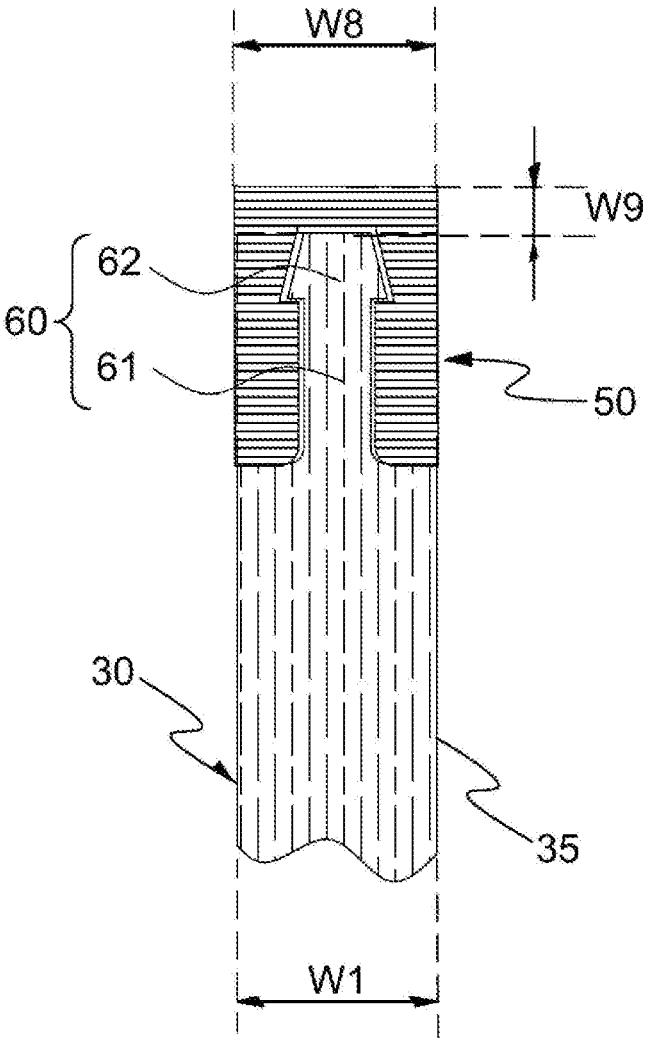

[Figure.10]
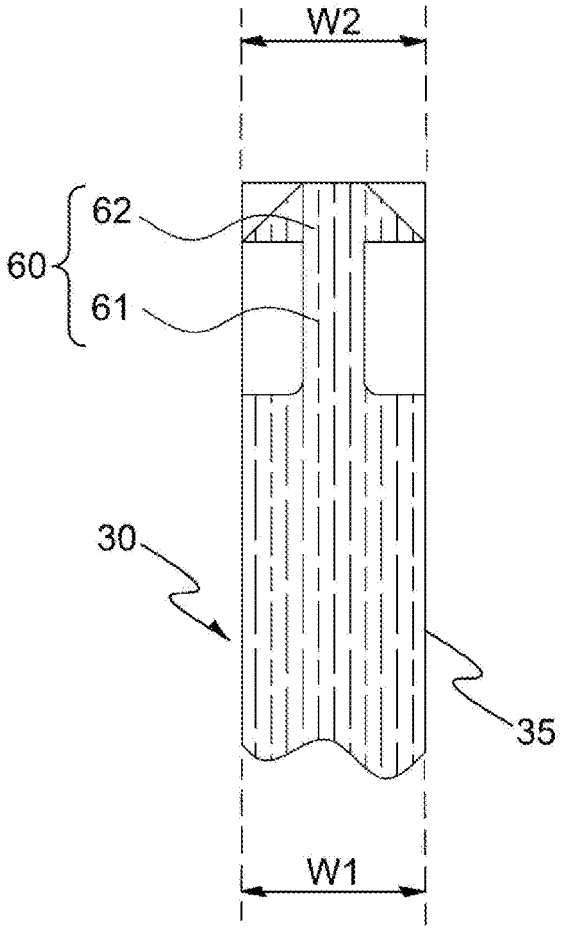

[Figure.11]
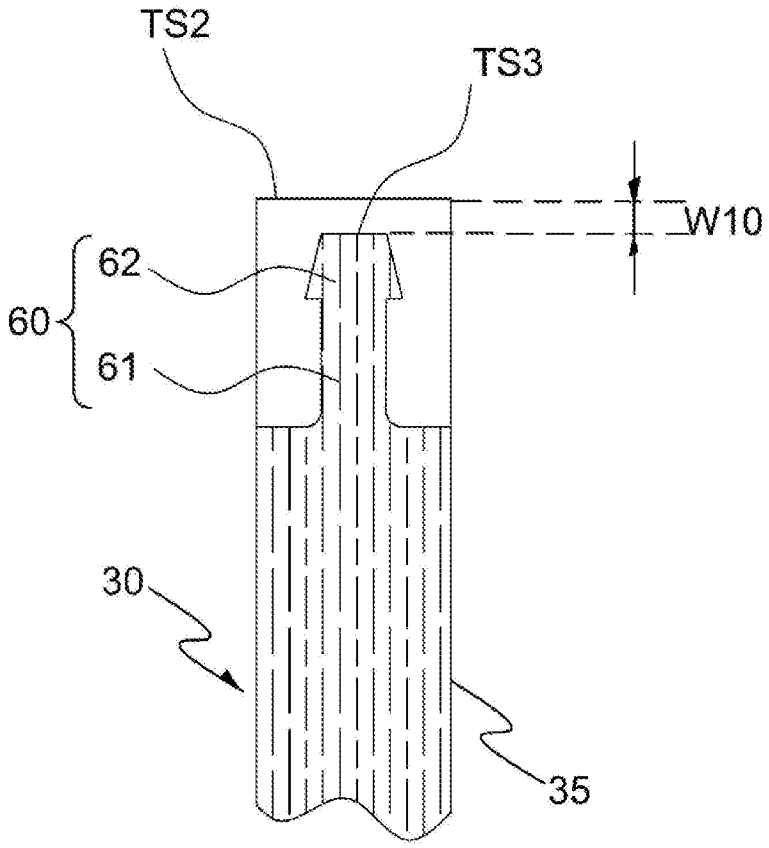

[Figure.12]
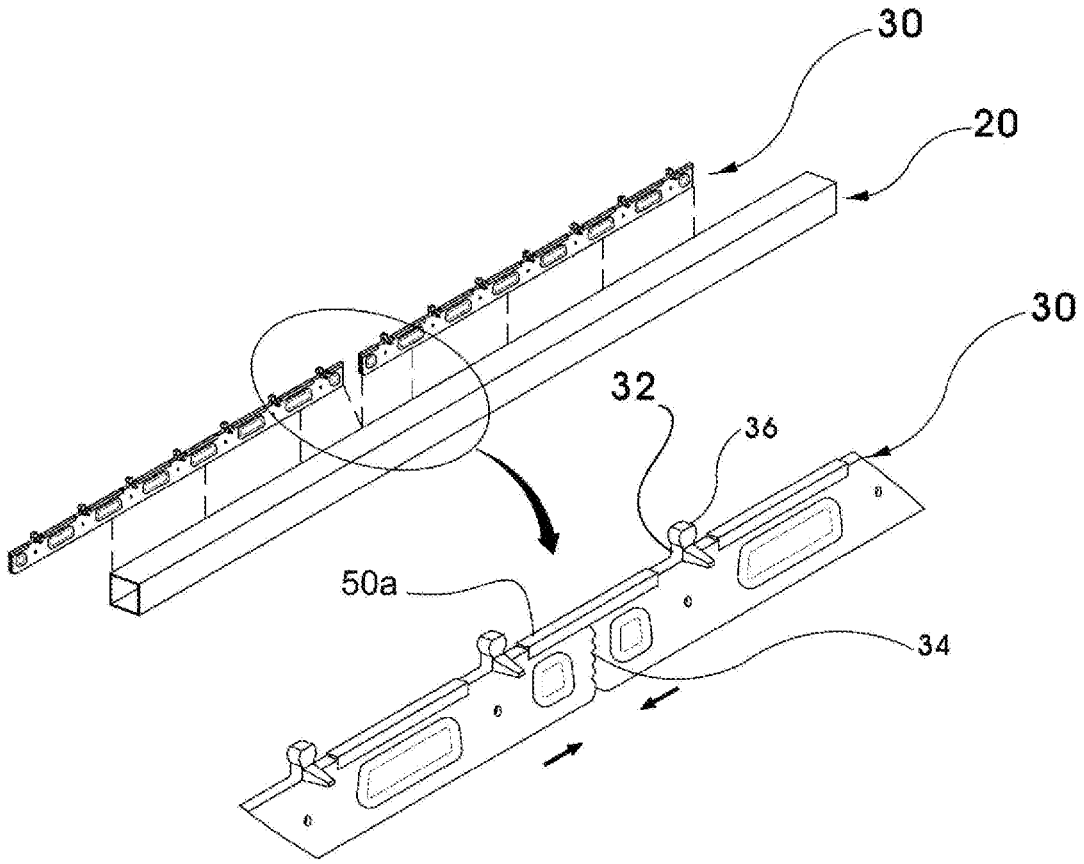

[Figure.14]
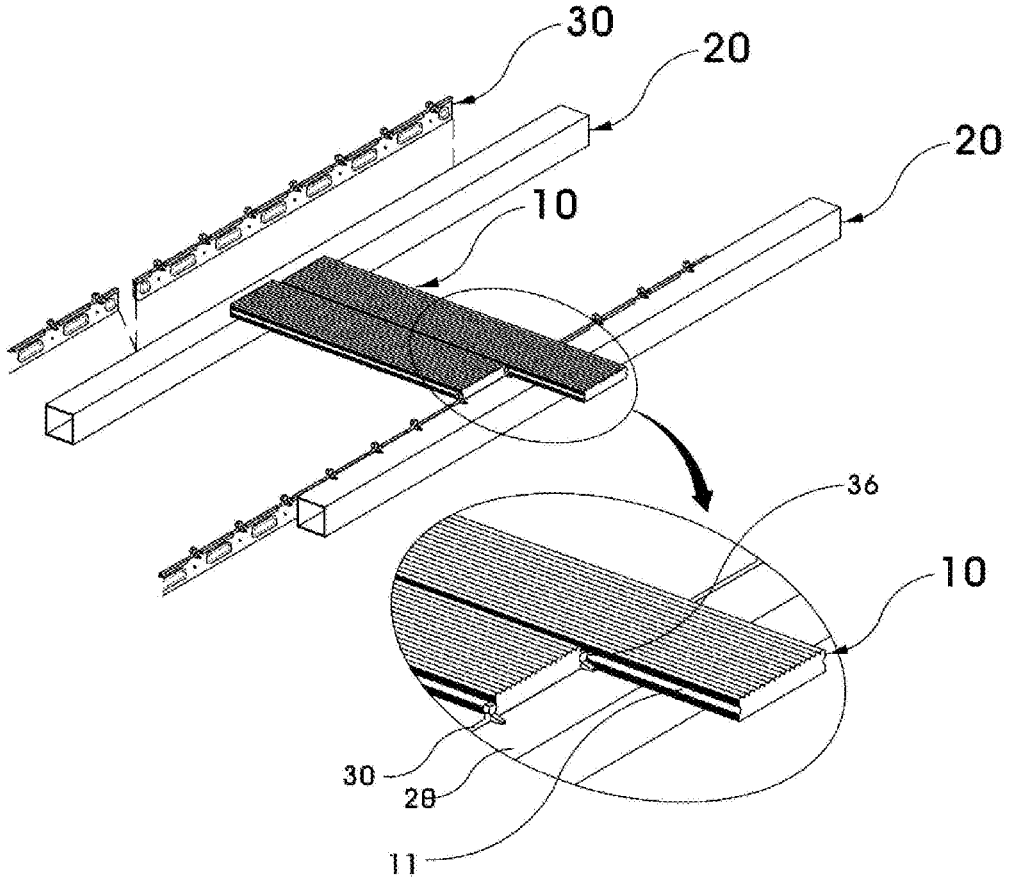

DECK MODULE INCLUDING QUICK CLIP MODULE

TECHNICAL FIELD

The present invention relates to a deck module including a quick clip module, and more particularly, to a deck module including a quick clip module which is very easy to construct, greatly facilitates defect repair, can present both the firmness of direct piece connection construction and the beauty of appearance obtained by a clip construction method, prevents a pedestrian's body from being injured when the pedestrian walks barefoot on the deck module by not exposing a piece or nail, and is constructed very quickly.

BACKGROUND ART

The conventional walking deck installation method can be divided into two types.

A first type refers to a direct piece connection construction method of coupling a deck panel to a bottom structure by using pieces or nails.

A second type refers to a clip construction method using clip terminals in a bottom structure.

The conventional piece construction method has a very long construction period and has difficulty in repairing defects in deck panels.

Further, the conventional piece construction method has problems that the cost of initial installation materials is high, the construction is difficult, and, when a defect occurs, it is impossible to repair the defect in original form.

Accordingly, there is a demand for the development of a technique for overcoming the problems and providing a construction method in which the merits of the direct piece connection construction method and the clip construction method are combined.

RELATED ART DOCUMENT

Patent Documents

Patent Document 1: Korean Patent Registration No. 10-1754112 "Clip for Upper Plate Side Edge Coupling of Wood Deck"

Patent Document 2: Korean Patent Registration No. 10-1754110 "Clip for Upper Plate Coupling of Wood Deck"

DISCLOSURE OF THE INVENTION

Technical Problem

The present invention provides a deck module including a quick clip module which prevents a piece or nail used in a deck from being exposed to an upper portion thereof and is modularized, thereby significantly reducing a construction time.

Further, the present invention provides a deck module including a quick clip module which makes the exterior of a deck more beautiful and disperses, to the entirety thereof, an impact or noise due to walking, thereby improving walking comfort.

Further, the present invention provides a deck module including a quick clip module which levels a bottom structure more quickly and easily.

Further, the present invention provides a deck module including a quick clip module which enables quicker and easier defect repair.

The purposes of the present invention are not limited to those mentioned above, and other purposes not mentioned can be clearly understood by those skilled in the art from the following description.

Technical Solution

According to an embodiment of the present invention, a deck module includes: deck panels having a plate shape extending in a first direction and having deck grooves formed in both side surfaces thereof in the first direction; a bottom structure disposed on lower portions of the deck panels in a second direction crossing the first direction; and quick clip modules connected to a side surface of the bottom structure, wherein the quick clip modules include: quick clip bases extending in the second direction; quick clip protrusions protruding from the quick clip bases in a third direction orthogonal to the first direction and the second direction and having protrusion portions formed at ends of the quick clip protrusions to protrude in the second direction and correspond to the deck grooves; and quick clip supports protruding from the quick clip protrusions in the first direction.

Further, the quick clip bases may correspond to the side surface of the bottom structure, the quick clip supports may correspond to an upper surface of the bottom structure, fixing holes may be formed in the quick clip bases, and the deck module may further include fastening means passing through the fixing holes to couple the quick clip bases to the side surface of the bottom structure.

Further, the width of the quick clip bases may be smaller than or equal to the width of the bottom structure.

Further, the maximum width of the quick clip supports in the second direction may be smaller than or equal to the minimum width of the quick clip protrusions.

Further, quick clip leveling ends for leveling the quick clip bases and other adjacent quick clip bases may be formed at at least one ends of the quick clip bases in the second direction.

Further, the quick clip modules may further include buffer portions each disposed between two of the quick clip protrusions and disposed on the quick clip bases in the third direction,

Advantageous Effects

According to the embodiments, a deck module including a quick clip module, according to an embodiment of the present invention, prevents a pedestrian from being injured and has a beautiful exterior by not exposing, to an upper side of a deck block, fixing means such as a connecting quick clip module and a screw.

Further, the present invention may attach a buffer portion on a deck base to block or absorb an impact or noise due to walking, thereby improving the pedestrian's walking comfort.

Further, the present invention may modularize the quick clip module and the deck block to enable a regular connection, thereby significantly reducing a construction time.

Further, the present invention may connect the deck block to the quick clip module without using the fixing means such as a screw, thereby facilitating the construction and defect repair.

BRIEF DESCRIPTION OF THE DRAWINGS

FIG. 2 is a view for describing a process of coupling the quick clip module 30 for connecting a wood deck to a bottom structure 20 according to an embodiment of the present invention.

FIG. 3 is a perspective view illustrating an overall coupled state of the quick clip module 30 for connecting a wood deck and the bottom structure according to an embodiment of the present invention.

FIGS. 5 and 6 are views illustrating a buffer portions disposed on the quick clip base of the quick clip module, FIGS. 7A, 7B, 8, 9, 10 and 11 are views illustrating structures of mounting portions and buffer portions, and FIG. 12 a view illustrating a buffer portion overlapping two adjacent quick clip module.

FIG. 14 is a view for describing a process of coupling the quick clip module 30 to a deck block 10 according to an embodiment of the present invention.

MODE FOR CARRYING OUT THE INVENTION

Figure 1A:
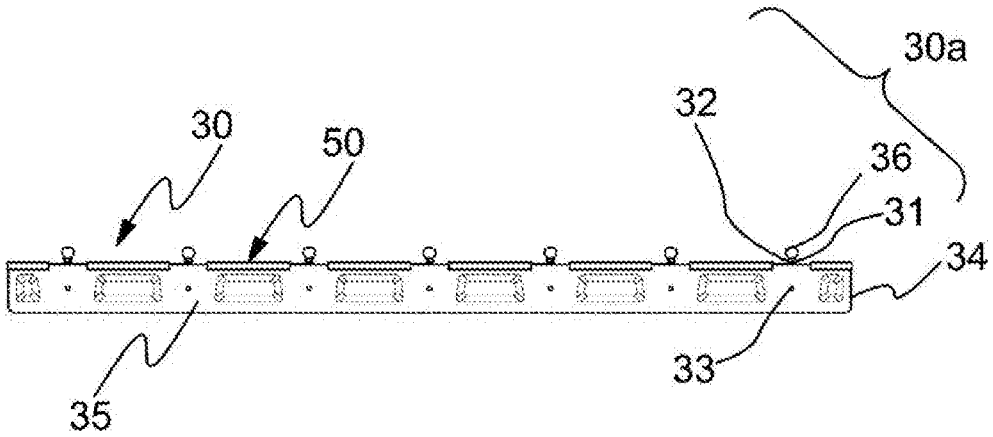
FIG. 1A is a front view of a quick clip module.
Figure 1B:
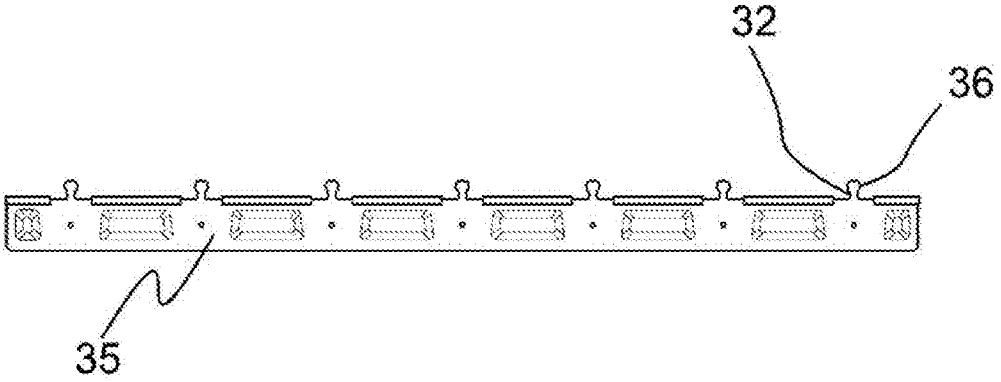
FIG. 1B is a rear view of the quick clip module.
Figure 1C:
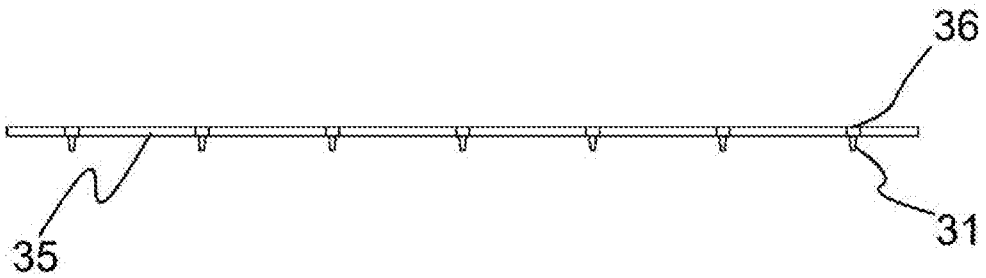
FIG. 1C is a plan view of the quick clip module.
Figure 1D:
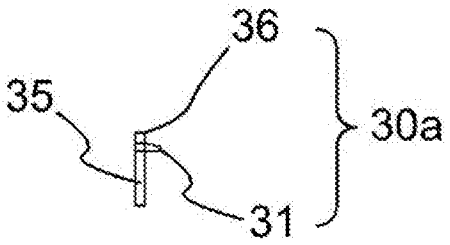
FIG. 1D is a cross-sectional view of the quick clip module.

A deck module including a quick clip module according to the present invention will be described below in detail with reference to the accompanying drawings.

The present invention may be modified in various forms and have various embodiments, and thus particular embodiments thereof will be illustrated in the drawings and described in the detailed description. However, it should be understood that the description set forth herein is not intended to limit the present invention, and encompasses all modifications, equivalents, and substitutions that do not depart from the spirit and scope of the present invention.

While such terms as "first" and "second," etc., may be used to describe various elements, such elements are not limited by the terms. The above terms are used only to distinguish one element from another. For example, a first element may be referred to as a second element without departing from the scope of rights of the present invention, and, likewise, a second element may be referred to as a first element.

The term "and/or" may include any and all combinations of a plurality of associated listed items.

It should be understood that, when an element is referred to as being "connected to" another element, it can be directly connected to the other element or intervening elements may also be present. In contrast, it should be understood that, when an element is referred to as being "directly connected to" another, no intervening elements are present.

The terminology used herein is for the purpose of describing particular embodiments only, and is not intended to limit the present invention. The singular forms "a," "an" and "the" are intended to include the plural forms as well, unless the context clearly indicates otherwise.

It should be understood that the terms "comprises," "comprising," "includes," and/or "including," when used herein, specify the presence of stated features, integers, steps, operations, elements, components and/or combinations thereof, but do not preclude the presence or addition of one or more other features, integers, steps, operations, elements, components and/or combinations thereof.

Unless defined otherwise, all the terms (including technical and scientific terms) used herein have the same meaning as commonly understood by one of ordinary skill in the art in the technical field to which the present invention belongs. It will be further understood that the terms, such as those defined in commonly used dictionaries, should be interpreted as having meanings that are consistent with their meanings in the context of the relevant art, and will not be interpreted in an idealized or overly formal sense unless expressly defined otherwise herein.

Further, the following embodiments are provided to those skilled in the art to describe the present invention more completely. The shapes and sizes of elements shown in the drawings may be exaggerated for clarity.

Detailed descriptions of well-known functions and structures incorporated herein may be omitted to avoid obscuring the subject matter of the present invention.

A configuration of a deck module including a quick clip module according to the present invention will be described below with reference to FIGS. 1 to 4.

FIG. 1 is views illustrating a front view (FIG. 1A), a rear view (FIG. 1B), a plan view (FIG. 1C), and a cross-sectional view (FIG. 1D) of a quick clip module 30 for connecting a wood deck according to an embodiment of the present invention. FIG. 2 is a view for describing a process of coupling the quick clip module 30 to a bottom structure 20 according to an embodiment of the present invention. FIG. 3 is a perspective view illustrating an overall coupled state of the quick clip module 30 and the bottom structure according to an embodiment of the present invention. FIG. 4 is views for describing a quick clip protrusion and a protruding portion.

Referring first to FIG. 1, the quick clip module 30 may include a quick clip base 35 having a rectangular panel shape to be attached to one side surface of the bottom structure 20.

The quick clip base 35 may have a height the same as or similar to that of the bottom structure 20 in an erected state.

The quick clip base 35 may have fixing holes 33 and quick clip leveling ends 34 in addition to quick clip supports 31 and quick clip protrusions 32 used as connecting pieces 30*a*.

Protrusion portions 36*a* and 36*b*, corresponding to deck grooves 11 of each of deck panels 10 to be described below, may be formed at ends of the quick clip protrusions 32. This document describes only a case in which the protrusion portions are formed at the ends of the quick clip protrusions 32, respectively. However, a case in which a protrusion portion is formed at one of the ends of the quick clip protrusions 32 may be possible. The quick clip protrusions 32, on which two protrusion portions are formed, may be referred to as a dual protrusion, and the quick clip protrusions 32, on which one protrusion portion is formed, may be referred to as a single protrusion.

The bottom structure 20 may support the quick clip module 30 and the deck panels 10.

The bottom structure 20 may have a hexahedral structure having a square or rectangular cross section (see FIG. 2) and formed by a preset length in a transverse direction X.

In this document, a direction (the transverse direction X) in which the bottom structure 20 extends may be referred to as a second direction, a direction (a longitudinal direction Y)

in which the deck panels 10 extend may be referred to as a first direction, and a direction (a vertical direction Z) orthogonal to the first direction and the second direction may be referred to as a third direction.

Reference sign 50 of FIG. 1 refers to buffer portions 50 not having been described. The buffer portions will be described in detail with reference to FIGS. 5 to 12.

Referring to FIG. 2, the quick clip module 30 may include the quick clip base 35, the quick clip protrusions 32, and the quick clip supports 31.

The quick clip base 35 may have a plate shape extending in the transverse direction X (the second direction).

The quick clip protrusions 32 may protrude from the quick clip base 35 in the vertical direction Z (the third direction) orthogonal to the longitudinal direction Y (the first direction) and the transverse direction X, and at least one protrusion portion 36*a* or 36*b* protruding in the transverse direction X and corresponding to the deck grooves 11 may be formed at the ends of the quick clip protrusions 32.

The quick clip supports 31 may protrude from the quick clip protrusions 32 in the longitudinal direction Y. Preferably, the quick clip supports 31 may protrude from the quick clip protrusions 32 towards the bottom structure 20.

Here, the maximum width of the quick clip supports 31 in the transverse direction X may be smaller than or equal to the minimum width of the quick clip protrusions 32. In this case, the deck panels 10 may be prevented from being caught by the quick clip supports 31.

Referring to FIG. 3, a deck module 100 may include the deck panels 10, the bottom structure 20, and the quick clip module 30.

The deck panels 10 may have a rectangular plate shape extending in the longitudinal direction Y, and the deck grooves 11 may be formed in both side surfaces of the deck panels 10 in the longitudinal direction Y.

Further, a plurality of protrusions (an embossing shape) for preventing slippage during walking may be formed on upper portions of the deck panels 10.

The deck panels 10 may be referred to as "deck panels."

The deck panels 10 may be made of a wood, resin, and/or metal material. For example, when the deck panels 10 are made of a wood material, the deck panels 10 may be referred to as "wood blocks."

The bottom structure 20 may be disposed on lower portions of the deck panels 10 in the transverse direction X.

The quick clip module 30 may be coupled to a side surface of the bottom structure 20. Further, the quick clip module 30 may clamp the deck panels 10 on the bottom structure 20 to prevent the deck panels 10 from being separated.

In detail, in a state in which the quick clip module 30 and the bottom structure 20 are coupled, the quick clip base 35 of the quick clip module 30 may correspond to the side surface of the bottom structure 20, and the quick clip supports 31 may correspond to an upper surface of the bottom structure 20.

The deck panels 10 may be inserted between two adjacent quick clip protrusions 32. In detail, the deck panels may be fixed to the quick clip module 30 in a manner that protrusion portions 36 of the quick clip module 30 are inserted in the deck grooves 11 of the deck panels 10.

The fixing holes 33 may be formed in the quick clip base 35.

Predetermined fastening means 40 may be passed through the fixing holes 33 to couple the quick clip base 35 to the side surface of the bottom structure 20.

Holes (not illustrated), corresponding to the fixing holes 33, may be formed in the side surface of the bottom structure 20.

For structural stability, the width of the quick clip base 35 may be smaller than or equal to the width of the bottom structure 20 in the vertical direction Z. This may be confirmed through FIG. 12.

From different points of view, the quick clip module 30 and the bottom structure 20 may be conveniently leveled with each other by placing bottom surfaces of the quick clip supports 31 on the upper surface of the bottom structure 20 in the state in which the quick clip module 30 and the bottom structure 20 are coupled.

Further, the deck panels 10 may be fitted on the quick clip module 30 coupled to the bottom structure 20 so that the deck module may be constructed more quickly and easily and defects therein may be easily repaired.

The plurality of quick clip protrusions 32 may be disposed on the quick clip base 35 of the quick clip module 30 to be spaced apart from each other at equal intervals in the transverse direction X.

Meanwhile, the quick clip leveling end 34 for leveling another adjacent quick clip base 35 may be formed at at least one end of the quick clip base 35 in the transverse direction X.

The quick clip leveling end 34 may include protrusions and recesses for preventing separation thereof when being connected to another adjacent quick clip leveling end 34.

Here, it may be preferable that the quick clip leveling ends 34 be formed such that convex and concave ends of the protrusions and recesses on both sides thereof have asymmetrical shapes so that the protrusions and recesses of two quick clip modules 30 making contact with each other in the transverse direction X may be engaged with each other.

Thus, both height levels of the two successive quick clip modules 30 may be adjusted depending on a relative fastening location between the quick clip leveling ends 34 thereof.

The shapes of the protrusion portions 36, corresponding to the deck grooves 11 of the deck panels 10, may be variously changed. The cross sections of the protrusion portions 36 may be at least one among a circular shape, an elliptical shape, and a polygonal shape such as a diamond shape, a rhombic shape, or a quadrangular shape.

Figure 4A:
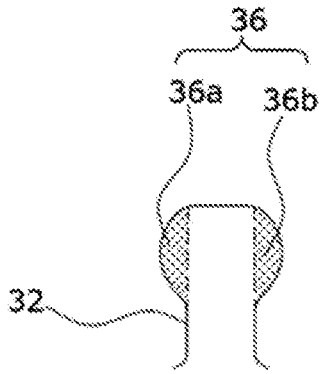
FIGS. 4A, 4B and 4C are views illustrating dual protrusion structures.

For example, as illustrated in FIG. 4A, the cross sections of the protrusion portions 36 formed on the quick clip protrusions 32 may be of a circular or elliptical type.

Figure 4B:
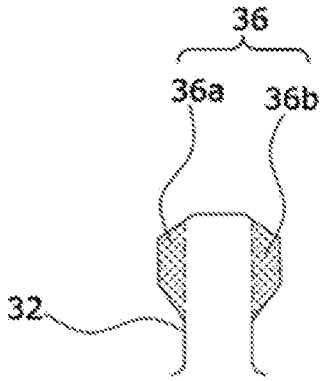
Figure 4C:
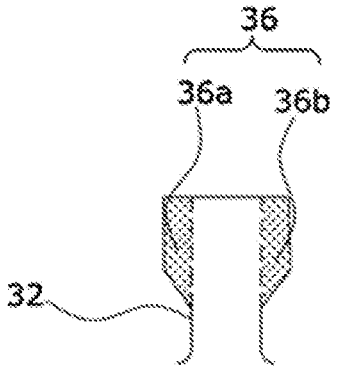

Alternatively, as illustrated in FIGS. 4B and 4C, the cross sections of the protrusion portions 36 may be of a polygonal type such as a quadrangular, rhombic, parallelogrammatic, or trapezoidal type.

Figure 4D:
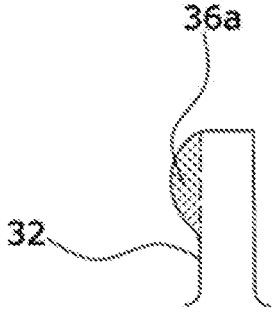
FIG. 4D is a view illustrating a single protrusion structure.

Alternatively, as illustrated in FIG. 4D, only one protrusion portion 36*a* may be formed on each of the quick clip protrusions 32.

FIGS. 4A, 4B, and 4C illustrate dual protrusion structures, and FIG. 4D illustrates a single protrusion structure.

As illustrated in FIG. 4D, the single protrusion structure may be located at an end of an edge of the deck module 100.

Alternatively, in consideration of ease and compatibility of manufacture, all of the protrusion portions 36 may be made as dual protrusion structures.

A groove having a predetermined space can be formed in the vertical central portion of the quick clip protrusions 32. This groove facilitates the joining of the deck panel 10 by shrinking and expanding so that the protrusions 32 can move to the left and right finely.

Meanwhile, the buffer portions may be disposed on the quick clip module 30 to further improve impact absorption and/or noise reduction performance. This will be described below with reference to the accompanying drawings.

FIGS. 5 to 12 are views for describing a deck module including a buffer portion. The descriptions of the elements described above may be omitted below. Further, the reference signs of the above-described elements may be omitted from the following drawings.

Referring to FIG. 5, the buffer portions 50 may be disposed on the quick clip base 35 of the quick clip module 30.

In detail, the buffer portions 50 may be mounted on the quick clip base 35 in the vertical direction Z (the third direction) between two quick clip protrusions 32.

The buffer portions 50 may include a soft material to effectively absorb or block an impact and/or noise. For example, the buffer portions 50 may be made of a rubber material, a resin material, a silicon material, a plastic material, and the like.

Considering manufacturing costs, the performance of absorbing or blocking an impact and/or noise, moldability, and the like, it may be preferable that the buffer portions 50 include a rubber material.

To mount the buffer portions 50, mounting portions 60 may be formed on the quick clip base 35.

The mounting portions 60 may include at least one buffer leg 51 or 52 to be mounted on the mounting portions 60.

The buffer legs 51 and 52 may protrude towards the quick clip base 35.

Each of the mounting portions 60 may be formed on a side surface of the quick clip base 35 in the transverse direction X (the second direction) between the two quick clip protrusions 32. Thus, the buffer portions 50 disposed on the mounting portions 60 may cross the deck panels 10.

As illustrated in FIGS. 5 and 6, the mounting portions 60 can be seen as being formed by deforming the shapes of portions of the side surface of the quick clip base 35 in response to the shapes of the buffer portions 50.

This document describes a case in which the mounting portions 60 are formed between the quick clip protrusions 32 one by one. However, the present invention is not limited thereto.

For example, it is assumed that a first quick clip base, a second quick clip base, and a third quick clip base are formed in one quick clip base 35.

Here, the mounting portion 60 may be formed between the first quick clip base and the second quick clip base, and the mounting portion 60 may not be formed between the second quick clip base and the third quick clip base.

The mounting portions 60 and the buffer portions 50 will be described in more detail with reference to FIGS. 7 to 11 as follows.

FIGS. 7 to 11 are views illustrating cross sections obtained by cutting the mounting portions 60 and the buffer portions 50 in the longitudinal direction Y (the first direction).

Figure 7A:
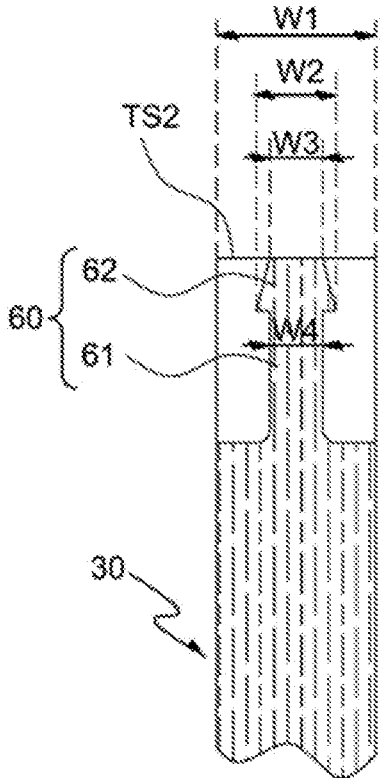

Referring to FIG. 7A, the mounting portion 60 may include a body portion 61 extending from the quick clip base 35 in the vertical direction Z (the third direction) and a head portion 62 extending from the body portion 61 in the vertical direction Z (the third direction).

The maximum width W2 of the head portion 62 may be greater than the width W4 of the body portion 61. The width W4 of the body portion 61 may be maintained approximately constant.

The width W2 of a portion of the head portion 62 adjacent to the body portion 61 may be greater than the width W3 of an end of the head portion 62. In such a case, the buffer portion 50 may be easily mounted on the mounting portion 60.

The width W1 of the quick clip base 35 may be greater than the width W4 of the body portion 61 and the maximum width W2 of the head portion 62.

An upper surface of the head portion 62 of the mounting portion 60 may substantially coincide with an upper surface of a portion of the quick clip base 35 adjacent to the mounting portion 60.

Figure 7B:
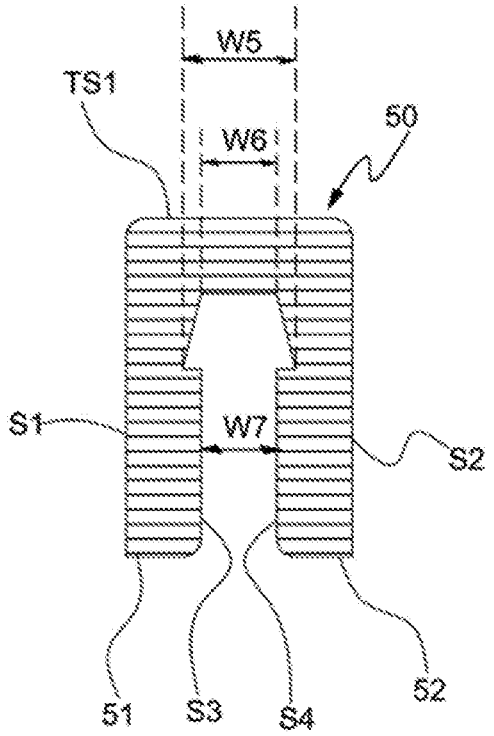

Referring to FIG. 7B, the shape of a space between a first buffer leg 51 and a second buffer leg 52 of the buffer portion 50 may correspond to the shape of the mounting portion 60.

For example, in a state in which the buffer portion 50 is mounted on the mounting portion 60, a gap W7 between an inner surface S3 of the first buffer leg 51 and an inner surface S4 of the second buffer leg 52 in an entrance of the buffer portion 50 may be smaller than the maximum gap W5 between the inner surface S3 of the first buffer leg 51 and the inner surface S4 of the second buffer leg 52 of the buffer portion 50.

Here, the maximum gap W5 of the buffer portion 50 may be a gap W7 at a location corresponding to that of the maximum width W2 of the head portion 62.

A gap W6 between the inner surface S3 of the first buffer leg 51 and the inner surface S4 of the second buffer leg 52 in a connection portion between the first buffer leg 51 and the second buffer leg 52 may be smaller than the maximum gap W5.

The buffer portion 50 may be coupled to the mounting portion 60 as illustrated in FIG. 8. In detail, at least the head portion 62 of the mounting portion 60 may be inserted in the space between the first buffer leg 51 and the second buffer leg 52 of the buffer portion 50.

In the state in which the buffer portion 50 is mounted on the mounting portion 60, a gap W8 between an outer surface S1 of the first buffer leg 51 and an outer surface S2 of the second buffer leg 52 may be greater than the width W1 of the quick clip base 35.

In such a case, in the state in which the quick clip module 30 and the bottom structure 20 are coupled, at least a portion of the first buffer leg 51 or the second buffer leg 52 may be positioned between the quick clip base 35 and the bottom structure 20. Thus, a friction between the quick clip module 30 and the bottom structure 20 may be prevented to further reduce noise.

In addition, in the state in which the buffer portion 50 is mounted on the mounting portion 60, the buffer portion 50 may protrude further than a portion of the quick clip base 35 adjacent to the buffer portion 50 by a predetermined height W9.

In other words, in the state in which the buffer portion 50 is mounted on the mounting portion 60, an upper surface TS1 of the buffer portion 50 may be positioned higher than an upper surface TS2 of the portion of the quick clip base 35 adjacent to the buffer portion 50 Referring to FIG. 11 by the predetermined height W9.

In such a case, the upper surface TS1 of the buffer portion 50 may make close contact with each of the deck panels 10, and thus an impact may be absorbed more effectively and generation of noise may be further inhibited.

Alternatively, as illustrated in FIG. 9, in the state in which the buffer portion 50 is mounted on the mounting portion 60, the gap W8 between the outer surface S1 of the first buffer leg 51 and the outer surface S2 of the second buffer leg 52 may be substantially the same as the width W1 of the quick clip base 35.

Referring to FIG. 10, the maximum width W2 of the head portion 62 of the mounting portion 60 may be substantially the same as the width W1 of the quick clip base 35. In such a case, the structural stability of the mounting portion 60 may be improved.

Referring to FIG. 11, the height of the mounting portion 60 may be lower than the height of another portion of the quick clip base 35 adjacent to the mounting portion 60 by a predetermined height W10.

In other words, an upper surface TS3 of the head portion 62 of the mounting portion 60 may be positioned lower than the upper surface TS2 of the other portion of the quick clip base 35 adjacent to the mounting portion 60.

In such a case, a connecting force between the mounting portion 60 and the buffer portion 50 may be improved.

Referring to FIG. 12, at least one buffer portion 50 may overlap two adjacent quick clip modules 30.

It is assumed that the first quick clip module and the second quick clip module are consecutively disposed.

Here, a common buffer portion 50*a* may be disposed between one outermost quick clip module 32 of the first quick clip module and another outermost quick clip module 32 of the second quick clip module.

The common buffer portion 50*a* may be connected to one mounting portion 60 formed on the first quick clip module and another mounting portion 60 formed on the second quick clip module in a region between the one outermost quick clip module 32 of the first quick clip module and the other outermost quick clip module 32 of the second quick clip module.

In such a case, even when the deck block 10 is disposed in a region between the two adjacent quick clip modules 30, noise and/or an impact may be reduced.

A method of constructing the deck module 100 including the quick clip modules 30 according to the present invention will be described below with reference to the accompanying drawings.

Figure 13A:
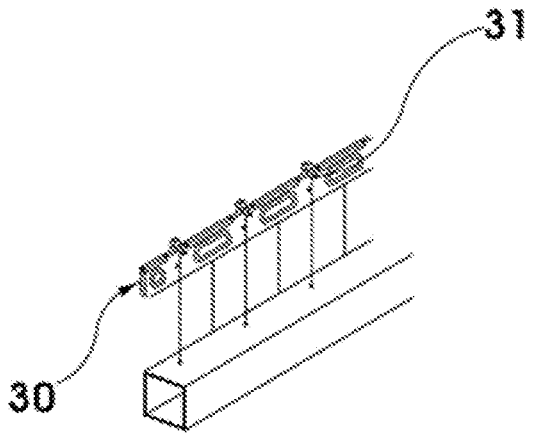
FIGS. 13A and 13B are views for describing a process of fixing the quick clip module 30 to the bottom structure 20 by using fastening means 40 in a state in which the quick clip module 30 and the bottom structure 20 are coupled according to an embodiment of the present invention.
Figure 13B:
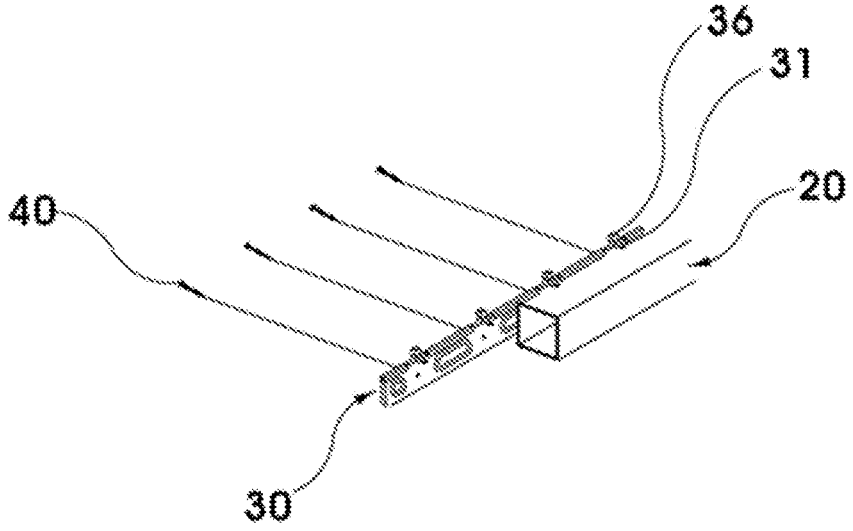

FIG. 13 is views for describing a process of fixing the quick clip module 30 to the bottom structure 20 by using fastening means 40 in a state in which the quick clip module 30 and the bottom structure 20 are coupled according to an embodiment of the present invention. FIG. 14 is a view for describing a process of coupling the quick clip module 30 to a deck block 10 according to an embodiment of the present invention. FIG. 15 is views illustrating a detailed process of coupling the quick clip module 30 to the deck block 10 according to an embodiment of the present invention.

First, as illustrated in FIG. 13, to horizontally couple the deck block 10 to the bottom structure 20, the bottom structure 20 is provided, and then use of the quick clip supports 31 of the quick clip module 30 allows the bottom structure 20 and the quick clip module 30 to be supported such that the heights of the bottom structure 20 and the quick clip module 30 are the same.

Then, the plurality of fastening means 40 may be passed through the fixing holes 33 formed in the quick clip module 30 to be fixed to the bottom structure 20.

Meanwhile, the fastening means 40 may couple the quick clip module 30 to the bottom structure 20, and then use of the quick clip leveling end 34 may allow a height level of the quick clip module 30 to be matched to that of another quick clip module 30 adjacent thereto in the transverse direction X.

Then, as illustrated in FIG. 14, the deck block 10 may be inserted between two adjacent quick clip protrusions 32. Here, the deck grooves 11 of the deck block 10 may correspond to the protrusion portions 36 formed on the two adjacent quick clip protrusions 32.

In this manner, the present invention may fasten the deck block 10 to the quick clip module 30 without using a fixing means such as a screw or nail. Thus, a time required for the construction may be reduced, and the difficulty of the construction may be lowered.

In detail, one of the deck grooves 11 formed in two side surfaces of the deck block 10 may be obliquely inserted between two quick clip protrusions 32 of the quick clip module 30, and then pressure F1 may be applied to the deck block 10 at a location opposite to that of the one deck groove 11 to dispose the deck block 10 on the quick clip module 30.

Figure 15A:
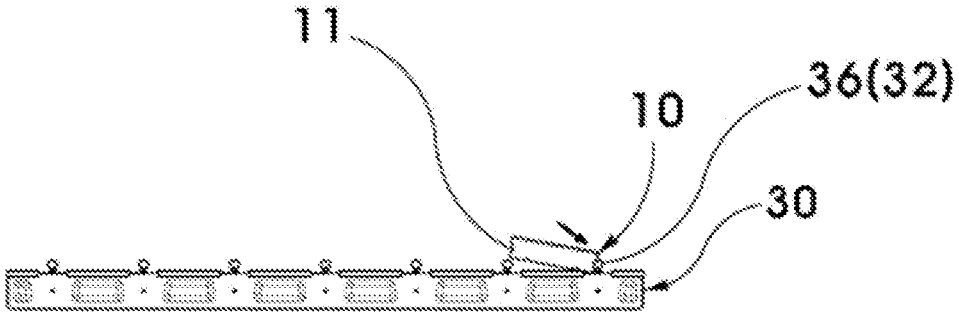
FIGS. 15A, 15B and 15C are views illustrating a detailed process of coupling the quick clip module 30 to the deck block 10 according to an embodiment of the present invention.

For a more detailed explanation, referring to FIG. 15, pressure may be applied to a side of the deck block 10 not corresponding to the quick clip protrusions 32, that is, the opposite side, to dispose the deck block 10 on the quick clip module 30, as illustrated in FIG. 15A.

Figure 15B:
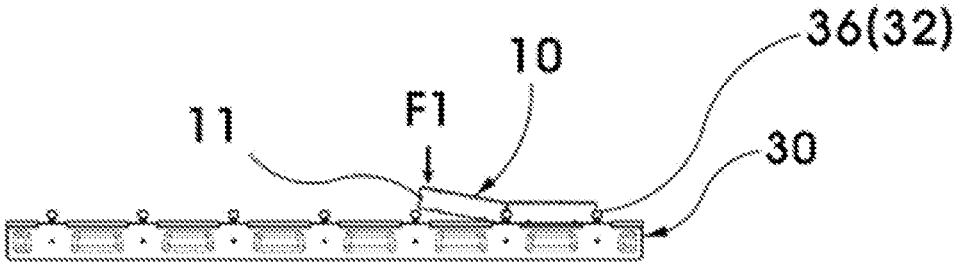
Figure 15C:
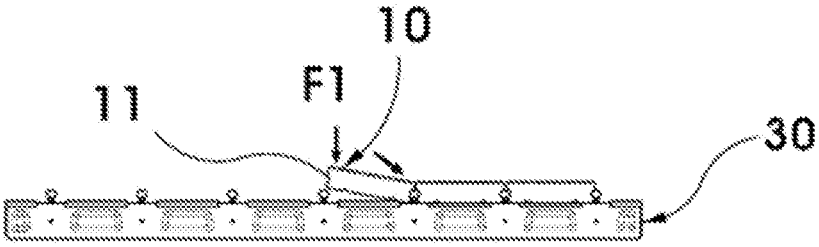

Then, as illustrated in FIGS. 15B and 15C, the deck panels 10 may be consecutively disposed on the quick clip module 30.

Likewise, the deck panels 10 may be coupled to the quick clip module 30 without using an additional tool, and thus the construction and defect repair may be facilitated.

Further, the present invention may cover the quick clip module 30 with the deck panels 10 in an upper portion of the deck module 100, thereby preventing the fixing means such as a screw or nail from being exposed. Thus, the safety of a pedestrian can be improved.

Further, the deck module 100 according to the present invention may allow the deck panels 10 to be disposed on the buffer portions 50 in the state in which the buffer portions 50 are mounted on the mounting portions 60. Thus, when the pedestrian steps on the deck panels 10 while walking, an impact thereon may be absorbed, blocked, or offset by the buffer portions 50, and thus the generation of noise may be reduced and walking comfort may be improved.

Further, the deck module 100 according to the present invention may make the deck panels 10 more tightly by means of the buffer portions 50, thereby compensating for a slipping phenomenon that may occur upon shrinkage of wood.

As described above, the exemplary embodiments of the present invention have been disclosed in this specification and drawings. Although specific terms are used herein, they are used in a common sense in order to easily explain the technical contents of the present invention and help an understanding of the present invention, but are not intended to limit the scope of the present invention. It would be obvious to those skilled in the art that various modifications based on the technical concept of the present invention can be made in addition to the embodiments disclosed herein.

The invention claimed is:

1. A deck module comprising:

deck panels having a plate shape extending in a first direction and having deck grooves formed in both side surfaces thereof in the first direction;

a bottom structure disposed on lower portions of the deck panels in a second direction crossing the first direction; and quick clip modules connected to a side surface of the bottom structure, wherein the quick clip modules comprise:

quick clip bases extending in the second direction;

quick clip protrusions protruding from the quick clip bases in a third direction orthogonal to the first direction and the second direction and having protrusion portions formed at ends of the quick clip protrusions to protrude in the second direction and correspond to the deck grooves; and quick clip supports protruding from the quick clip protrusions in the first direction, and further comprise buffer portions each disposed between two of the quick clip protrusions and disposed between the quick clip bases and the deck panels in the third direction, wherein the quick clip bases further comprise mounting portions inserted in the buffer portions in the third direction, wherein the mounting portions comprise:

body portions extending from the quick clip bases in the third direction; and head portions formed at ends of the body portions, wherein the maximum width of the body portions is smaller than the width of the quick clip bases and the maximum width of the head portions, the maximum width of the quick clip supports in the second direction is smaller than the maximum width of the quick clip protrusions, quick clip leveling ends for leveling the quick clip bases and other adjacent quick clip bases are formed at at least one ends of the quick clip bases in the second direction, a first quick clip module and a second quick clip module of the quick clip modules are disposed adjacent to each other, and in a boundary region between the first quick clip module and the second quick clip module, the quick clip leveling end formed at an end of a first quick clip base of the first quick clip module comprises first protrusions and recesses, and the quick clip leveling end formed at an end of a second quick clip base of the second quick clip module comprises second protrusions and recesses corresponding to the first protrusions and recesses.

2. The deck module of claim 1, wherein the quick clip bases correspond to the side surface of the bottom structure, the quick clip supports correspond to an upper surface of the bottom structure, fixing holes are formed in the quick clip bases, and further comprising fastening means passing through the fixing holes to couple the quick clip bases to the side surface of the bottom structure.

3. The deck module of claim 1, wherein at least one of the buffer portions overlaps the first quick clip module and the second quick clip module.

* * * * *